US009042764B2

(12) United States Patent
Suzaki

(10) Patent No.: US 9,042,764 B2
(45) Date of Patent: May 26, 2015

(54) POWER SUPPLY APPARATUS INTERLOCKED WITH ATTACHING AND DETACHING OPERATION OF UNIT

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Yoshikazu Suzaki, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/024,856

(22) Filed: Sep. 12, 2013

(65) Prior Publication Data

US 2015/0071675 A1 Mar. 12, 2015

(51) Int. Cl.
*G03G 15/00* (2006.01)
*H01R 13/631* (2006.01)

(52) U.S. Cl.
CPC ..... *H01R 13/6315* (2013.01); *G03G 15/80* (2013.01)

(58) Field of Classification Search
USPC ..... 399/75, 88–90, 107, 111; 439/13, 439/25–29
See application file for complete search history.

(56) References Cited

U.S. PATENT DOCUMENTS 5,742,872 A * 4/1998 Copperwheat et al. ..... 399/92
7,945,184 B2 * 5/2011 Takagi ..... 399/90
8,588,640 B2 * 11/2013 Kubo et al. ..... 399/90

FOREIGN PATENT DOCUMENTS

JP 07-160599 6/1995

* cited by examiner

*Primary Examiner* — Hoan Tran
(74) *Attorney, Agent, or Firm* — Amin, Turocy & Watson, LLP

(57) ABSTRACT

In accordance with one embodiment, a power supply apparatus includes a movable terminal section configured to be attached on or detached from and electrically connected with a fixed terminal section corresponding to the attaching or detaching of a unit on or from a main body; a sliding section configured to support the movable terminal section and slide; a guide stud which has a positioning section inserted into the guide hole of the sliding section, a shaft section smaller in sectional area than the positioning section and a connection section for connecting the positioning section with the shaft section, configured to guide the sliding section; and an elastic section configured to press the sliding section towards a unit terminal section.

9 Claims, 6 Drawing Sheets

POWER SUPPLY APPARATUS INTERLOCKED WITH ATTACHING AND DETACHING OPERATION OF UNIT

FIELD

Embodiments described herein relate to a power supply apparatus for electrically connecting the main body of an apparatus with a unit detachably attached on the main body.

BACKGROUND

As a power supply apparatus for electrically connecting the main body of an apparatus such as an image forming apparatus with various detachable unit, there is a drawer connector which has a guide function of correcting the deviation between the terminal at the side of the unit and the terminal at the side of the main body of an apparatus.

The deviation between the terminal at the side of the unit and the terminal at the side of the main body of the apparatus, if higher than a degree of freedom based on the guide function of the drawer connector, may put a burden on the drawer connector and damage the drawer connector.

DETAILED DESCRIPTION

In accordance with one embodiment, a power supply apparatus includes a movable terminal section configured to be attached on or detached from and electrically connected with a fixed terminal section corresponding to the attaching or detaching of a unit on or from a main body; a sliding section configured to support the movable terminal section and slide; a guide stud, which has a positioning section inserted into the guide hole of the sliding section, a shaft section smaller in sectional area than the positioning section and a connection section for connecting the positioning section with the shaft section, configured to guide the sliding section; and an elastic section configured to press the sliding section towards a unit terminal section.

Figure 1:
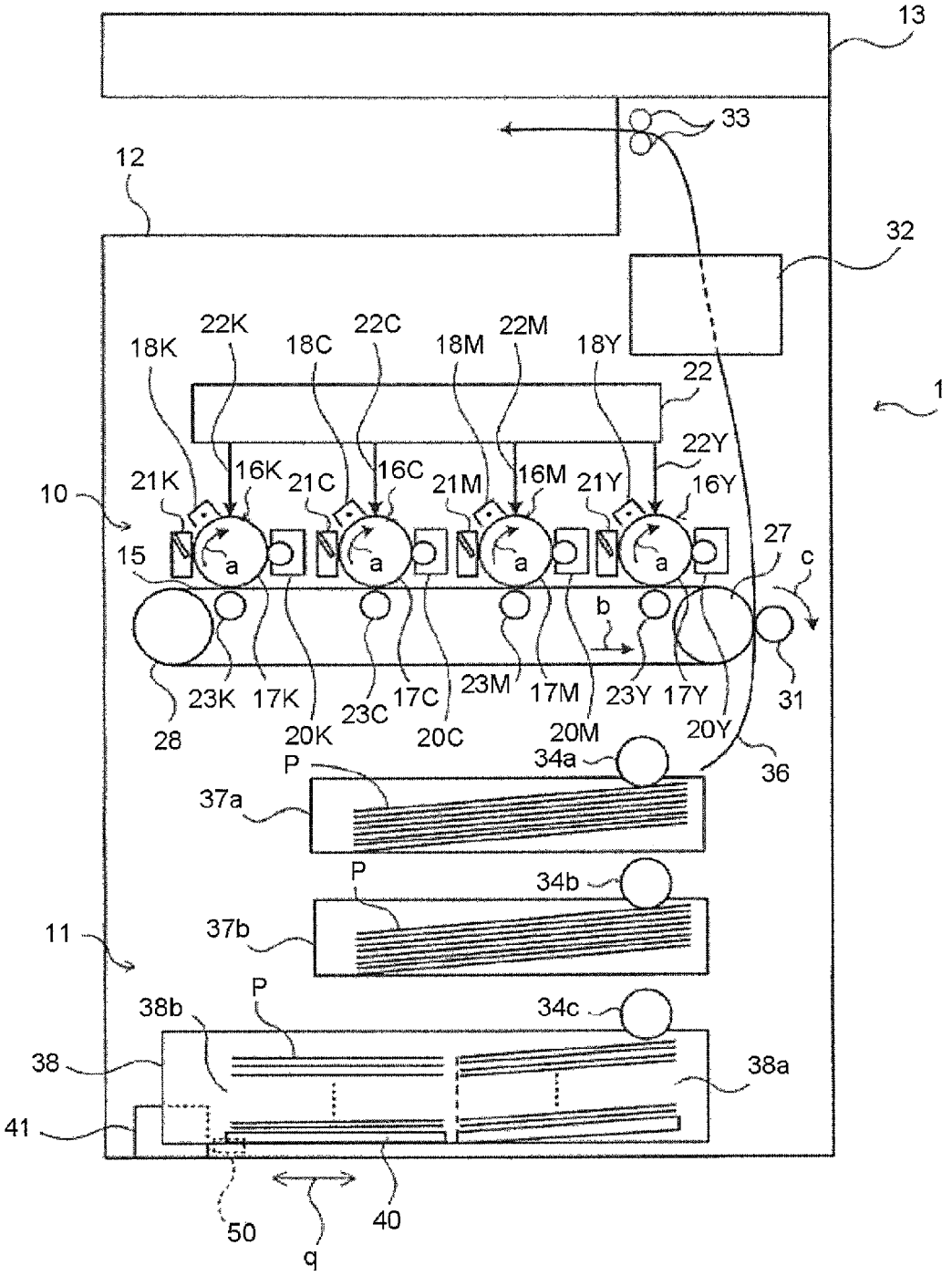
FIG. 1 is a schematic constitution diagram illustrating a MFP according to an embodiment.

Embodiments are described below. FIG. 1 is a schematic constitution diagram illustrating a color MFP (Multi Functional Peripheral) 1, which is, for example, an image forming apparatus, serving as a main body according to an embodiment. The MFP 1 comprises a printer section 10 serving as an image forming section, a paper feed section 11, a paper discharging section 12 and a scanner 13.

The paper feed section 11 has a first paper feed cassette 37*a*, a second paper feed cassette 37*b* and a high-capacity paper feed cassette 38 serving as a unit. The paper feed cassettes 37*a*, 37*b* and 38 have pickup rollers 34*a*, 34*b* and 34*c*, respectively, for picking up a sheet P serving as a recording medium.

The printer section 10 comprises yellow (Y), magenta (M), cyan (C) and black (K) image forming stations 16Y, 16M, 16C and 16K which are arranged in parallel along an intermediate transfer belt 15. The image forming stations 16Y, 16M, 16C and 16K have photoconductive drums 17Y, 17M, 17C and 17K, respectively.

The image forming stations 16Y, 16M, 16C and 16K are provided with chargers 18Y, 18M, 18C and 18K, developing apparatuses 20Y, 20M, 20C and 20K and photoconductor cleaners 21Y, 21M, 21C and 21K around the photoconductive drums 17Y, 17M, 17C and 17K rotating in a direction indicated by the arrow a. The printer section 10 comprises a laser exposure apparatus 22 constituting an image forming unit. The laser exposure apparatus 22 irradiates the photoconductive drums 17Y, 17M, 17C and 17K with laser lights 22Y, 22M, 22C and 22K having corresponding colors. The laser exposure apparatus 22 irradiates laser lights to form electrostatic latent images on the photoconductive drums 17Y, 17M, 17C and 17K.

The printer section 10 is provided with a backup roller 27 and a driven roller 28 for supporting the intermediate transfer belt 15 to make the intermediate transfer belt 15 move in a direction indicated by the arrow b. The printer section 10 is provided with primary transfer rollers 23Y, 23M, 23C and 23K at positions respectively opposite to the photoconductive drums 17Y, 17M, 170 and 17K across the intermediate transfer belt 15. The primary transfer rollers 23Y, 23M, 23C and 23K primarily transfer toner images formed on the photoconductive drums 17Y, 17M, 170 and 17K to the intermediate transfer belt 15 and overlap the toner images in sequence. The photoconductor cleaners 21Y, 21M, 21C and 21K remove the toner left on the photoconductive drums 17Y, 17M, 17C and 17K in the primary transfer.

The printer section 10 is provided with a secondary transfer roller 31 at a position opposite to the backup roller 27 across the intermediate transfer belt 15. The secondary transfer roller 31 is driven by the intermediate transfer belt 15 to rotate in a direction indicated by the arrow c. The printer section 10 conveys a sheet P fed from the paper feed section 11 to the secondary transfer roller 31 along a conveyance path 36 at the timing when the toner images transferred to the intermediate transfer belt 15 reach the secondary transfer roller 31. During a secondary transfer, the printer section 10 forms a transfer bias at the nip between the intermediate transfer belt 15 and the secondary transfer roller 31 to secondarily transfer all the toner images on the intermediate transfer belt 15 to the sheet P. The printer section 10 comprises a fixing section 32 at the downstream side of the secondary transfer roller 31 along the conveyance path 36.

If the MFP 1 starts a print operation, the image formed by the printer section 10 is transferred to and fixed on a sheet P fed from the paper feed section 11 and then discharged to the paper discharging section 12 by a paper discharging roller pair 33. The image forming apparatus, which is not limited to be in a tandem form, may be in a revolver form, and no limitation is given to the number of the developing apparatuses. The image forming apparatus may be an apparatus which directly transfers a toner image from a photoconductor to a recording medium.

The high-capacity paper feed cassette 38 is described below in detail. The high-capacity paper feed cassette 38, which has a first storage section 38*a* and a second storage section 38*b* for storing sheets P, can be pulled out from the front side of the MFP 1, for example, to replenish the first storage section 38*a* and the second storage section 38*b* with sheets P. The high-capacity paper feed cassette 38 comprises a feed mechanism 40 for feeding the sheets P in the second storage section 38*b* to the first storage section 38*a* when the first storage section 38*a* is empty.

The feed mechanism 40 is driven, for example, by a drive section 41 provided with a motor, to reciprocate in a direction indicated by the arrow q. The feed mechanism 40 returns to the second storage section 38*b* after feeding sheets P from the second storage section 38*b* to the first storage section 38*a*. A drawer connector 50 arranged at the rear side of the MFP1 supplies power to the drive section 41.

Figure 2:
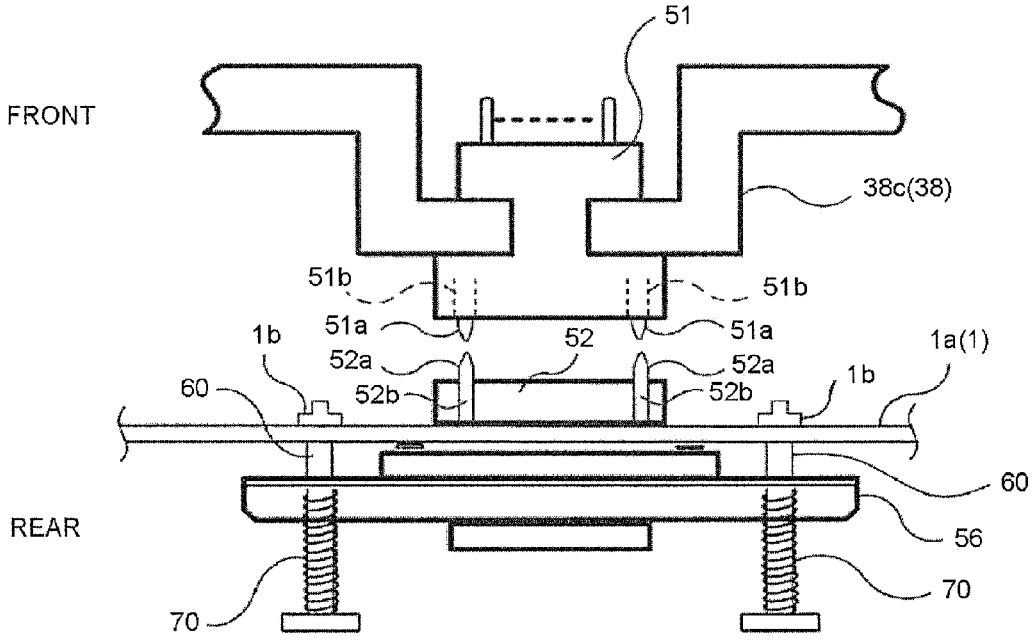
FIG. 2 is a schematic constitution diagram illustrating a drawer connector in a state of approaching an insertion terminal to a power supply terminal when observed from the top according to an embodiment.

As shown in FIG. 2, the drawer connector 50 comprises a fixed terminal section, that is, an insertion terminal 51 serving as the unit terminal section, and a power supply terminal 52 serving as a movable terminal section. The power supply terminal 52 is connected with a power source to supply power to the insertion terminal 51. The rear frame 38*c* of the high-capacity paper feed cassette 38 fixedly supports the insertion terminal 51. A housing frame 1*a* of the MFP 1 supports the power supply terminal 52 to slide.

The drawer connector 50 attaches and detaches the insertion terminal 51 to and from the power supply terminal 52 corresponding to the attaching or detaching of the high-capacity paper feed cassette 38 on or from the MFP 1. When the high-capacity paper feed cassette 38 is pulled out from the front side of the MFP 1, the insertion terminal 51 of the drawer connector 50 separates from the power supply terminal 52. When the high-capacity paper feed cassette 38 is attached on the MFP 1, the drawer connector 50 inserts the insertion terminal 51 into the power supply terminal 52.

Figure 3:
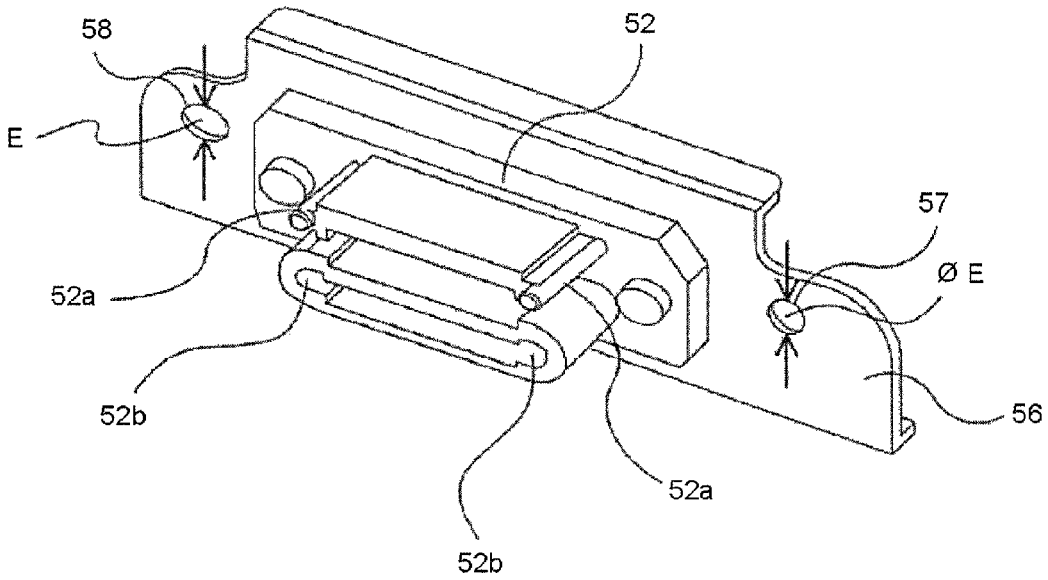
FIG. 3 is a schematic perspective view illustrating a power supply terminal and a supporting metal plate according to an embodiment.

The insertion terminal 51 has a pin 51*a*, which is inserted into a pin support 52*b* serving as a guide plug of the power supply terminal 52 shown in FIG. 3. The power supply terminal 52 has a pin 52*a*, which is inserted into the pin support 51*b* serving as a guide plug of the insertion terminal 51.

Figure 4:
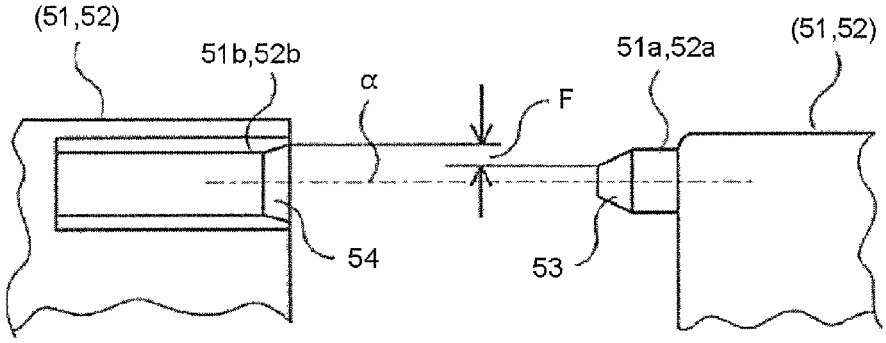
FIG. 4 is a schematic illustration diagram illustrating a pin guide and a pin support of a drawer connector according to an embodiment.

As shown in FIG. 4, the pins 51*a* and 52*a* both have a tapered pin guide 53 serving as an inclined guide on the front end thereof. The pin insertion guides 54 at entrances of the pin supports 51*b* and 52*b* are widely formed and have an inclination so as to easily insert a pin guide 53. Even if the insertion terminal 51 is slightly deviated from the power supply terminal 52, the pins 51*a* and 52*a* and the pin supports 51*b* and 52*b* can correct the deviation. The pins 51*a* and 52*a* and the pin supports 51*b* and 52*b* guide the insertion terminal 51 to be inserted into the power supply terminal 52. The difference in level on the pin guide 53 is, for example, F. A one dotted lines a represents a center line of the pin guide 53.

Figure 5:
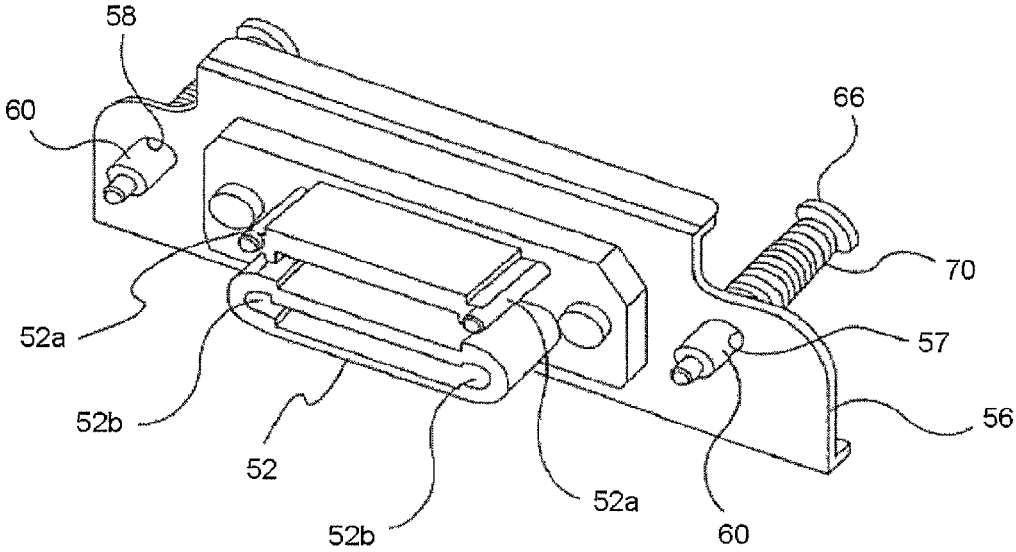
FIG. 5 is a schematic perspective view illustrating supporting of a supporting metal plate based on studs according to an embodiment.
Figure 6:
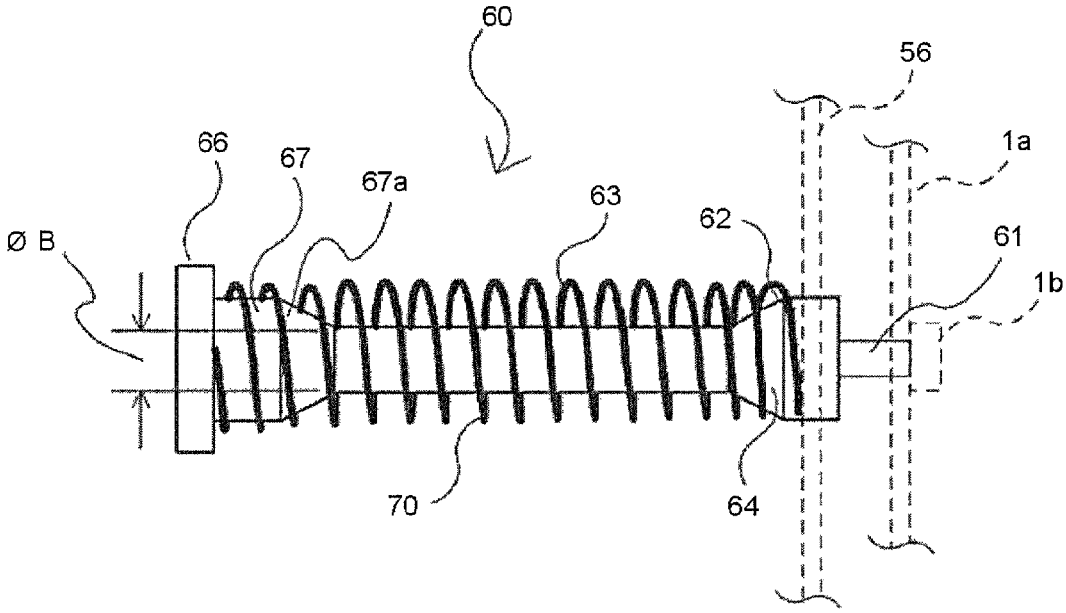
FIG. 6 is a schematic illustration diagram illustrating a stud and a coil spring according to an embodiment.

The main body frame 1*a* of the MFP 1 supports the supporting metal plate 56 serving as a sliding section to slide. The supporting metal plate 56 fixedly supporting the power supply terminal 52 comprises a circular first metal plate hole 57 and an oval second metal plate hole 58 serving as guide holes. The supporting metal plate 56 slides along studs 60 serving as guide studs (shown in FIG. 5 and FIG. 6) which are inserted in the first metal plate hole 57 and the second metal plate hole 58, respectively. The first metal plate hole 57 has a diameter (ϕE). The second metal plate hole 58 is an oval having a minor axis (E). The oval second metal plate hole 58 regulates the deviation generated when the supporting metal plate 56 is mounted on the main body frame 1*a* via the studs 60.

The stud 60 has a base portion 62 serving as a positioning section at the side of an apical portion 61 which is fixed on the main body frame 1*a* by a screw 1*b*. The stud 60 has a shaft 63 serving as a shaft section and a taper 64 serving as a connection section between the base portion 62 and the shaft 63. The stud 60 has a spring supporting plate 66 serving as a spring stopper at the rear end and a second connection section 67 having a taper 67*a* between the spring supporting plate 66 and the shaft 63.

The diameter of the section of the base portion 62 of the stud 60 is ϕE. The base portion 62 is inserted into the first metal plate hole 57 and the second metal plate hole 58 to position the supporting metal plate 56. The diameter (ϕ3) of the section of the shaft 63 of the stud 60 is smaller than the diameter (ϕE) of the base portion 62. The diameter (ϕB) of the shaft 63 is smaller than the diameter of the first metal plate hole 57 and the minor axis of the second metal plate hole 58. No limitation is given to the size of the diameter (ϕB) of the shaft as long as the first metal plate hole 57 and the second metal plate hole 58 won't be jammed by the shaft 63 when the supporting metal plate 56 slides obliquely. It is preferred that the diameter (ϕ3) of the shaft meets the following relationship: $\phi E - \phi B > F$.

There is a coil spring 70 serving as an elastic section between the main body frame 1*a* and the spring supporting plate 66. The coil spring 70 presses the supporting metal plate 56 towards the insertion terminal 51. The coil spring 70 applies a force stronger than a force required for inserting the insertion terminal 51 into the power supply terminal 52. However, the elastic force of the coil spring 70 is a force sufficiently small compared with the locking force for maintaining the attaching state of the high-capacity paper feed cassette 38.

The separation or connection of the drawer connector 50 corresponding to the attaching or detaching of the high-capacity paper feed cassette 38 on or from the MFP 1 is described below. For example, when the pulled out high-capacity paper feed cassette 38 is inserted into the MFP 1, the insertion terminal 51 of the drawer connector 50 approaches the power supply terminal 52, as shown in FIG. 2.

Figure 7:
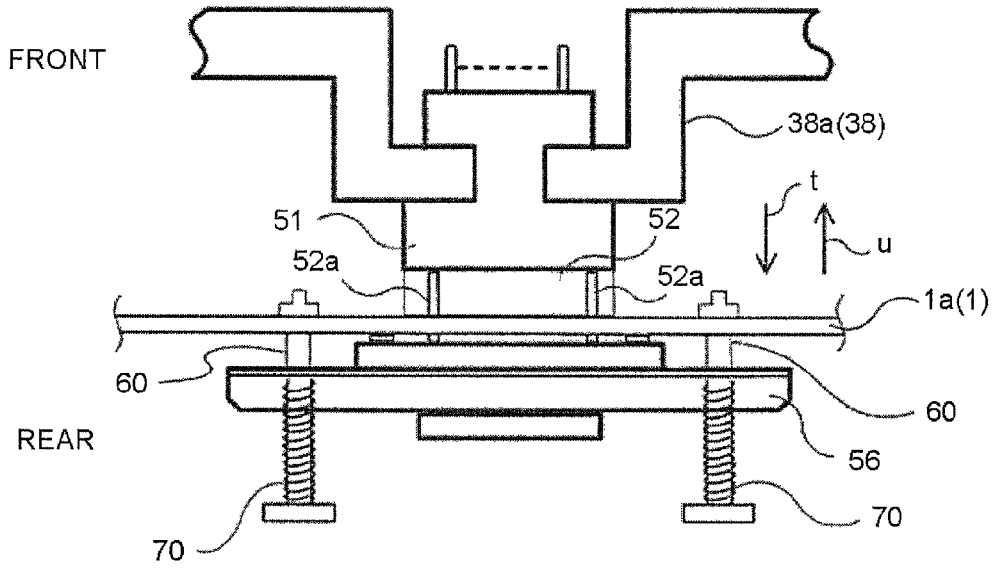
FIG. 7 is a schematic constitution diagram illustrating a drawer connector in a state in which an insertion terminal is contacted with a power supply terminal when observed from the top according to an embodiment.
Figure 8:
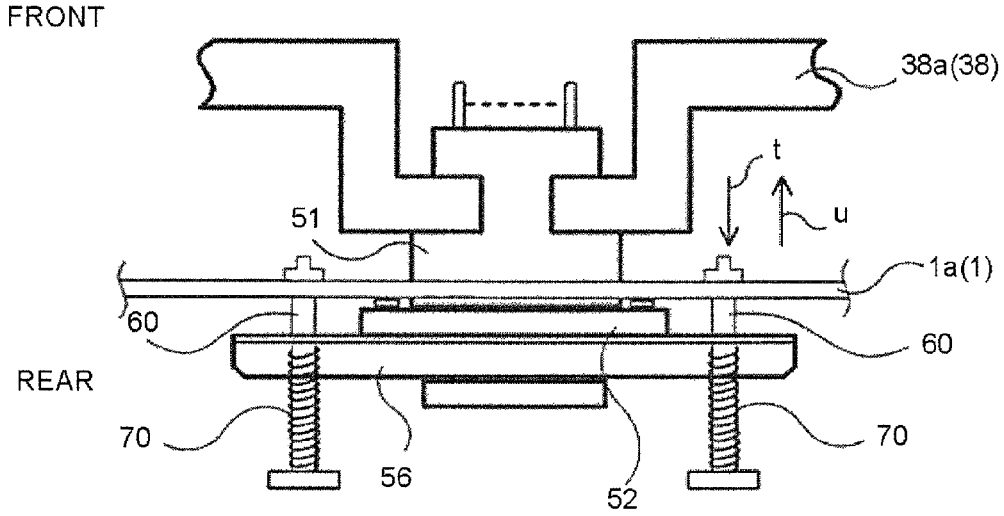
FIG. 8 is a schematic constitution diagram illustrating a drawer connector in a state in which an insertion terminal is inserted into a power supply terminal when observed from the top according to an embodiment.

The high-capacity paper feed cassette 38 is further inserted to a attaching position on the MFP 1, the insertion terminal 51 of the drawer connector 50 is contacted with the power supply terminal 52, as shown in FIG. 7. Then, the insertion terminal 51 of the drawer connector 50 is inserted into the power supply terminal 52, as shown in FIG. 8. When the insertion terminal 51 is contacted with the power supply terminal 52, the insertion terminal 51 presses the supporting metal plate 56 to slide towards the direction indicated by the arrow t against the pressure force of the coil spring 70. The insertion terminal 51 is inserted into the power supply terminal 52 while pressing the power supply terminal 52 towards the direction indicated by the arrow t.

Figure 9:
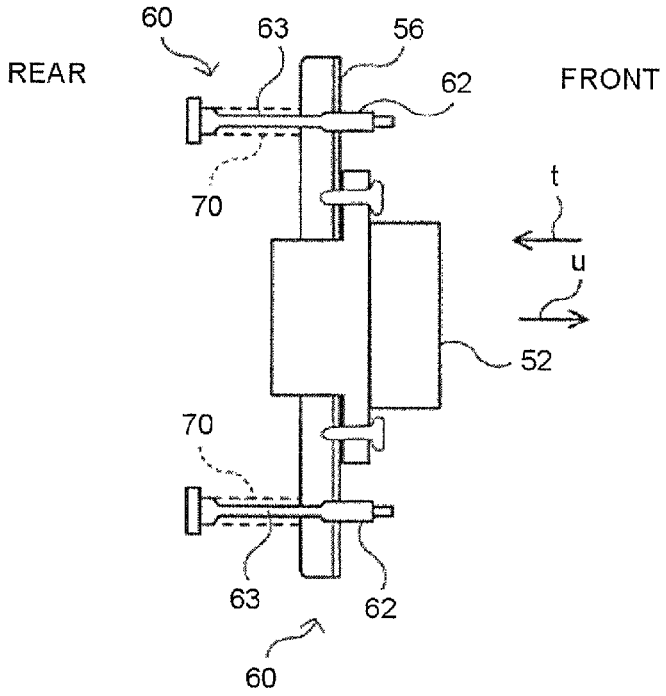
FIG. 9 is a schematic illustration diagram illustrating a state in which a supporting metal plate slides perpendicularly to studs according to an embodiment.

As shown in FIG. 9, when the supporting metal plate 56 slides perpendicularly to studs 60 in the direction indicated by the arrow t, the pressure force of the insertion terminal 51 is uniformly applied to the power supply terminal 52. The insertion terminal 51 is smoothly inserted into the power supply terminal 52. After the insertion terminal 51 is inserted into the power supply terminal 52, the power supply terminal 52 moves in a direction indicated by the arrow u under the pressure force of the coil spring 70. The power supply terminal 52 moves in the direction indicated by the arrow u to an optimal position corresponding to the fixed position of the insertion terminal 51 fixed in the high-capacity paper feed cassette 38 and then stops.

When the power supply terminal 52 is located at the optimal position, the base portion 62 of the stud 60 is inserted into the first metal plate hole 57 and the second metal plate hole 58 to stably position the power supply terminal 52. When the power supply terminal 52 moves in the direction indicated by the arrow u, the first metal plate hole 57 and the second metal plate hole 58, even if located at the position on the shaft 63, can smoothly move to the base portion 62 along the taper 64. For example, when the deformation of the coil spring 70 causes a deviation, the tapers 64 and 67*a* arranged at two sides of the shaft 63 of the stud 60 can make the coil spring 70 return to normal positions.

Figure 10:
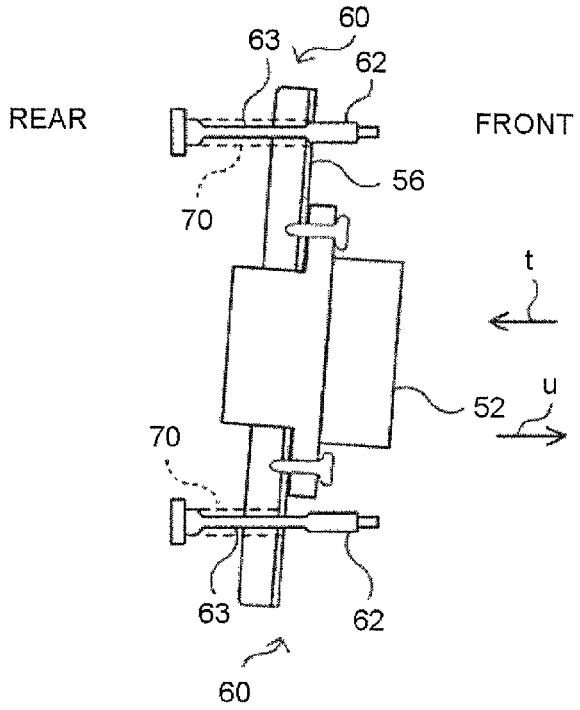
FIG. 10 is a schematic illustration diagram illustrating a state in which a supporting metal plate slides obliquely according to an embodiment.

When the insertion terminal 51 presses the power supply terminal 52 in the direction indicated by the arrow t, the supporting metal plate 56 sometimes slides obliquely with respect to the stud 60, as shown in FIG. 10. The first metal plate hole 57 or the second metal plate hole 58 also slides along the thin shaft 63 in the direction indicated by the arrow t even if the supporting metal plate 56 slides obliquely. Thus, even if the supporting metal plate 56 slides obliquely, there is no worry about that the first or second metal plate hole 57 or 58 is jammed by the stud 60 and stops sliding.

The supporting metal plate 56 can continue sliding along the shaft 63 in the direction indicated by the arrow t even if the supporting metal plate 56 slides obliquely with respect to the stud 60. When the supporting metal plate 56 is sliding in the direction indicated by the arrow t, the insertion terminal 51 is guided by the pin guide 53 and the pin insertion guide 54 to be suitably inserted into the power supply terminal 52 and stopped at a given position.

The power supply terminal 52 moving in the direction indicated by the arrow t is pressed back by the coil spring 70 once the insertion terminal 51 and the high-capacity paper feed cassette 38 stop at a given position. The metal plate holes 57 and 58 of the supporting metal plate 56 move along the taper 64 in the direction indicated by the arrow u, meanwhile, the pressed back power supply terminal 52 is smoothly inserted into the insertion terminal 51 and stopped at an optimal position.

The insertion terminal 51 is separated from the power supply terminal 52 corresponding to the pulling out operation of the high-capacity paper feed cassette 38 from the MP1. If the insertion terminal 51 is pulled out along the direction indicated by the arrow u when the drawer connector 50 is in an inserted state, as shown in FIG. 8, the supporting metal plate 56 is contacted with the rear frame 1*a* and then stops. The insertion terminal 51, if is further pulled out along the direction indicated by the arrow u, is separated from the power supply terminal 52.

As a comparative example of the stud 60 described in the embodiment, a columnar stud having the same diameter with the metal plate hole of the supporting metal plate is used as a guide for sliding the supporting metal plate. In the comparative example, when the supporting metal plate slides obliquely, the metal plate hole is sometimes jammed by the stud. Once the metal plate hole is jammed by the stud, the supporting metal plate stops sliding at the jamming position. The power supply terminal supported by the supporting metal plate is locked obliquely and cannot slide.

The insertion terminal, even if compulsively pressed into the power supply terminal which is locked obliquely and cannot slide, cannot be suitably inserted into the power supply terminal. In the comparative example, as the insertion terminal cannot be suitably inserted into the power supply terminal, the power supply to the high-capacity paper feed cassette is unstable. Further, in the comparative example, as the insertion terminal is compulsively pressed into the power supply terminal which is locked obliquely and cannot slide, the drawer connector will be damaged.

According to the embodiment, the shaft 63 having a diameter smaller than the base portion 62 is arranged on the stud 60 for guiding the supporting metal plate 56 to slide. The base portion 62 is connected with the shaft 63 via the taper 64. In a case where the high-capacity paper feed cassette 38 is attached on the MFP 1, even if the supporting metal plate 56 slides obliquely, a problem can be avoid that the supporting metal plate 56 is jammed by the studs 60 and stops sliding. The insertion terminal 56 can be suitably inserted into the power supply terminal 52 during the continuous sliding period of the supporting metal plate 56 even if the supporting metal plate 56 slides obliquely. The unstable power supply to the high-capacity paper feed cassette 38 and the damage of the drawer connector 50 can be prevented even when the supporting metal plate 56 slides obliquely.

In the embodiment, a unit may further be a fixing section or a unitized image forming station, but not limited to the high-capacity paper feed cassette. The fixed terminal section and the movable terminal section are not limited to be arranged at given positions, for example, the fixed terminal section may be fixed at the side of the main body, and the movable terminal section is arranged at the side of the unit. If an electric connection is achieved when the fixed terminal section is inserted into the movable terminal section, the fixed terminal section may be connected with a power source to supply power to the movable terminal section. Further, the connection section of the guide stud may also be curve-shaped as long as the connection section enables the guide hole of the sliding section to slide between the positioning section and the shaft. Further, in the embodiment, the main body, which is not limited to be an image forming apparatus, may be any apparatus provided with a detachable unit needing an electric connection, such as, an image erasing apparatus.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A power supply apparatus, comprising:

a movable terminal section configured to be attached on or detached from and electrically connected with a fixed terminal section corresponding to the attaching or detaching of a unit on or from a main body;

a sliding section configured to support the movable terminal section and slide;

a guide stud, which has a positioning section inserted into a guide hole of the sliding section, a shaft section smaller in sectional area than the positioning section and a connection section for connecting the positioning section with the shaft section, configured to guide the sliding section; and an elastic section configured to press the sliding section towards a unit terminal section.

2. The power supply apparatus according to claim 1, wherein the fixed terminal section is a unit terminal fixed on the unit, the sliding section slides towards or away from the main body, and the guide stud is fixed on the main body.

3. The power supply apparatus according to claim 2, wherein the guide stud fixes an apical portion at the side of the positioning section on the main body; and the elastic section is a coil spring into which the guide stud is inserted and applies a pressure in a direction of separating the sliding section from the spring stop section at the rear end part of the guide stud.

4. The power supply apparatus according to claim 1, further comprising:

a guide plug configured to guide the fixed terminal section and the movable terminal section to an inserting position, wherein when the difference in level on an inclined guide at the front end of the guide plug is F, the diameter of the guide hole is $\phi E$, and the diameter of the shaft section is $\phi B$, then F, $\phi E$, and $\phi B$ meet the following relationship: $\phi E - \phi B > F$.

5. An image forming apparatus, comprising:

a main body configured to include an image forming section for forming an image on a recording medium;

a movable terminal section configured to be attached on or detached from and electrically connected with a fixed terminal section corresponding to the attaching or detaching of a unit on or from the main body;

a sliding section configured to support the movable terminal section and slide;

a guide stud, which has a positioning section inserted into a guide hole of the sliding section, a shaft section smaller in sectional area than the positioning section and a connection section for connecting the positioning section with the shaft section, configured to guide the sliding section; and an elastic section configured to press the sliding section towards a unit terminal section.

6. The image forming apparatus according to claim 5, wherein the fixed terminal section is a unit terminal fixed on the unit, the sliding section slides towards or away from the main body, and the guide stud is fixed on the main body.

7. The image forming apparatus according to claim 6, wherein the guide stud fixes an apical portion at the side of the positioning section on the main body; and the elastic section is a coil spring into which the guide stud is inserted, and applies a pressure in a direction of separating the sliding section from the spring stop section at the rear end part of the guide stud.

8. The image forming apparatus according to claim 5, further comprising:

a guide plug configured to guide the fixed terminal section and the movable terminal section to an inserting position, wherein when the difference in level on an inclined guide at the front end of the guide plug is F, the diameter of the guide hole is $\phi E$, and the diameter of the shaft is $\phi B$, then F, $\phi E$, and $\phi B$ meet the following relationship: $\phi E - \phi B > F$.

9. The image forming apparatus according to claim 5, wherein the unit is a paper feed cassette for storing the recording medium fed to the image forming section.

* * * * *